US007472016B2

(12) United States Patent
Takeyama et al.

(10) Patent No.: US 7,472,016 B2
(45) Date of Patent: Dec. 30, 2008

(54) START CONTROL APPARATUS FOR INTERNAL COMBUSTION ENGINE

(75) Inventors: Masaki Takeyama, Okazaki (JP); Makoto Nakamura, Okazaki (JP); Minoru Kato, Toyota (JP); Rentaro Kuroki, Susono (JP)

(73) Assignees: Toyota Jidosha Kabushiki Kaisha, Toyota (JP); Nippon Soken, Inc., Nishio (JP)

( * ) Notice: Subject to any disclaimer, the term of this patent is extended or adjusted under 35 U.S.C. 154(b) by 75 days.

(21) Appl. No.: 11/791,031

(22) PCT Filed: Jan. 10, 2006

(86) PCT No.: PCT/JP2006/300410

§ 371 (c)(1),
(2), (4) Date: May 18, 2007

(87) PCT Pub. No.: WO2006/075726

PCT Pub. Date: Jul. 20, 2006

(65) Prior Publication Data

US 2008/0154484 A1 Jun. 26, 2008

(30) Foreign Application Priority Data

Jan. 13, 2005 (JP) ..... 2005-006312
Oct. 7, 2005 (JP) ..... 2005-295023

(51) Int. Cl.
*F02D 45/00* (2006.01)

(52) U.S. Cl. ..... 701/113; 123/179.4

(58) Field of Classification Search ..... 701/113, 701/112, 115, 102; 123/295, 491, 492, 179.4
See application file for complete search history.

(56) References Cited

U.S. PATENT DOCUMENTS

| | | | | |
|---|---|---|---|---|
| 5,809,973 | A | 9/1998 | Iida et al. | |
| 6,058,346 | A * | 5/2000 | Wachi et al. | 701/55 |
| 6,205,776 | B1 * | 3/2001 | Otsuka | 123/492 |
| 6,257,197 | B1 * | 7/2001 | Nishimura et al. | 123/295 |
| 7,007,667 | B2 * | 3/2006 | Borg et al. | 123/491 |
| 2003/0051692 | A1 | 3/2003 | Mizutani | |

FOREIGN PATENT DOCUMENTS

| | | | |
|---|---|---|---|
| EP | 1 288 491 | A2 | 3/2003 |
| FR | 2 843 613 | A1 | 2/2004 |
| JP | A 2000-213385 | | 8/2000 |
| JP | A 2001-73774 | | 3/2001 |
| JP | A 2002-242724 | | 8/2002 |
| JP | A 2004-36561 | | 2/2004 |
| WO | WO 2006/013167 | A1 | 2/2006 |

* cited by examiner

*Primary Examiner*—Hieu T Vo
(74) *Attorney, Agent, or Firm*—Oliff & Berridge, PLC

(57) ABSTRACT

There is provided a start control apparatus for an internal combustion engine (1) which starts the engine with injecting fuel to each cylinder (2) of the internal combustion engine in an intake stroke. The apparatus comprises a stop position distinction device (20) which distinguishes a piston position at a time of a stop of the internal combustion engine, and a fuel injection amount control device (20) which specifies a cylinder in which a piston stops in the intake stroke based on a distinction result of the stop position distinction device and which increases a fuel injection amount at starting for the specified cylinder more than a fuel injection amount for other cylinders.

9 Claims, 7 Drawing Sheets

START CONTROL APPARATUS FOR INTERNAL COMBUSTION ENGINE

TECHNICAL FIELD

The present invention relates to an apparatus that controls a fuel amount to be injected to a cylinder of an internal combustion engine at starting.

BACKGROUND ART

As a start control apparatus for a cylinder direct injection type internal combustion engine which is subjected to idle stop control, there is known a start control apparatus in which, when fuel feed pressure during an idle stop state goes below a predetermined pressure, fuel is injected to each of a cylinder in which a piston stops in a compression stroke and a cylinder in which a piston stops in an intake stroke and then performs an intake stroke injection at restarting, thereby promptly starting the engine (see, for example, Japanese Patent Application Laid-Open (JP-A) No. 2004-36561). In addition, JP-A Nos. 2001-73774, 2000-213385, and 2202-242724 are other publications with related arts to the present invention.

In case that the internal combustion engine stops due to the idle stop control, the cylinder in which the piston stops in the intake stroke sucks air because an intake valve is opened, and therefore pressure in the cylinder may increase from a negative pressure state at the timing of the stop to atmospheric pressure or therearound. If restarting is performed under such situation, adiabatic compression begins around the atmospheric pressure in the cylinder of the intake stroke, and cylinder temperature exceeds ignition temperature of the fuel, so that self-ignition phenomena may be generated. The self-ignition causes problems such as increasing vibration. The start control apparatus disclosed in JP-A No. 2004-36561 injects the fuel in the cylinder in the intake stroke during the idle stop state merely for the purpose of securing the fuel amount at restarting, and therefore effect of restraining the above-described self-ignition at restarting cannot be expected. Also, the above-described self-ignition problem is not limited to the cylinder direct injection type internal combustion engine but may occur in the so-called port injection type internal combustion engine. Furthermore, the self-ignition problem is not limited to the case of restarting from the idle stop state, but may occur in the case that the internal combustion engine restarts prior to sufficient reduction of the cylinder temperature after the internal combustion engine stops in response to an action of turning the ignition switch off.

DISCLOSURE OF THE INVENTION

Here, one of objects of the present invention is to provide a start control apparatus for an internal combustion engine capable of restraining self-ignition at starting in a cylinder in which the piston stops in an intake stroke.

To solve the above described problems, according to the first aspect of the present invention, there is provided a start control apparatus for an internal combustion engine which starts the engine with injecting fuel to each cylinder of the internal combustion engine in an intake stroke, comprising: a stop position distinction device which distinguishes a piston position at a time of a stop of the internal combustion engine; and a fuel injection amount control device which specifies a cylinder in which a piston stops in the intake stroke based on a distinction result of the stop position distinction device and which increases a fuel injection amount at starting for the specified cylinder more than a fuel injection amount for other cylinders.

According to the start control apparatus of the first aspect, more fuel is injected to the cylinder in which the piston starts its operation from the intake stroke when starting the internal combustion engine than the fuel injection amount for other cylinders. Accordingly, cylinder temperature drop effect due to fuel vaporization latent heat is higher in comparison with those in other cylinders, and the generation of the self-ignition is restrained by maintaining lower cylinder temperature even if the compression stroke starts under the state that cylinder pressure increases due to suction of air during stopping. Therefore, the problems such as increase of vibration accompanying the self-ignition can be restrained, thereby starting the internal combustion smoothly.

To solve the above described problems, according to a second aspect of the present invention, there is provided a start control apparatus for an internal combustion engine which starts the engine with injecting fuel to each cylinder of the internal combustion engine in an intake stroke, comprising: a stop position distinction device which distinguishes a piston position at a time of a stop of the internal combustion engine; and a fuel injection amount control device which distinguishes whether or not a position of a piston stopping in the intake stroke is within a predetermined crank angle range with a start position of the intake stroke as a base point based on a distinction result of the stop position distinction device and which controls a fuel injection amount at starting for the cylinder in which the piston stops in the intake stroke based on a distinction result regarding the predetermined crank angle range.

According to the start control apparatus of the second aspect, distinguishing whether or not the position of the piston stopping in the intake stroke is within the predetermined crank angle range from the start position of the intake stroke allows to appropriately control the fuel injection amount for the cylinder in which the piston starts its operation from the intake stroke. For example, between an initial stage and a mid stage of the intake stroke, a remaining intake time is long, intake flow rate and velocity are high fuel, so that intake air can sufficiently be mixed with each other, and intake temperature is lower than the cylinder temperature. Therefore, the cylinder temperature drop effect due to vaporization latent heat is effectively exerted. In such a case, the fuel injection amount is increased to restrain the generation of the self-ignition. On the other hand, in a final stage of the intake stroke, the remaining intake time is short and the intake flow rate and velocity are reduced, so that the fuel amount necessary to reduce the cylinder temperature using the vaporization latent heat is rapidly increased. Therefore, it is difficult to provide the cylinder temperature drop effect appropriate for the increase of the fuel. In such a case, the fuel injection amount is relatively reduced to thereby restrain problems such as deterioration of a fuel consumption and emission.

In one embodiment of the start control apparatus according to the second aspect, when the position of the piston stopping in the intake stroke is within the predetermined crank angle range, the fuel injection amount control device may increase the fuel injection amount at starting for the cylinder in which the piston stops in the intake stroke more than a fuel injection amount for other cylinders. Alternatively, when the position of the piston stopping in the intake stroke is within the predetermined crank angle range, the fuel injection amount control device may increase the fuel injection amount at starting for the cylinder in which the piston stops in the intake stroke more than in the case of exceeding the predetermined crank angle range. According to these embodiments, the cylinder temperature drop effect by the vaporization latent heat can certainly and effectively be exerted by increasing the fuel amount in a predetermined range from the start of the intake stroke.

In one embodiment of the start control apparatus according to the second aspect, when the position of the piston stopping in the intake stroke exceeds the predetermined crank angle range, the fuel injection amount control device may distinguish whether or not self-ignition will generate in the cylinder in which the piston stops in the intake stroke with referring to at least one physical value in correlation to temperature in the cylinder at starting and may inhibit the fuel injection at starting to the cylinder when distinguishing that the self-ignition will generate. According to this embodiment, the fuel injection is inhibited when the cylinder temperature drop effect using the vaporization latent heat of the fuel may not be sufficient to restrain the self-ignition, thereby certainly preventing the self-ignition in the compression stroke.

In the embodiment of the start control apparatus according to the second aspect, the fuel injection amount control device may distinguish whether or not the self-ignition will generate with referring, when starting, to at least one of temperature of cooling water of the internal combustion engine, atmospheric pressure in an environment in which the internal combustion engine is located, air temperature of the environment, humidity of the environment, fuel temperature, and wall surface temperature of the cylinder in which the piston stops in the intake stroke as the physical value. By referring to these physical values, the possibility of self-ignition can appropriately be determined.

In one embodiment of the start control apparatus according to the second aspect, the internal combustion engine may be subjected to idle stop control which stops the internal combustion engine when a predetermined stop condition is satisfied and restarts the internal combustion engine when a predetermined restart condition is satisfied, and when restarting from a stop state due to the idle stop control, the fuel injection amount control device may perform control of the fuel injection amount based on the distinction result of the piston position. According to this embodiment, even if the cylinder temperature at restarting from the idle stop state is high, generation of the compression self-ignition can effectively be restrained. Furthermore, the fuel injection amount control device may distinguish whether or not self-ignition will generate with referring to duration of a stop state due to the idle stop control as the physical value. Between the duration of the stop state and the cylinder temperature, there is correlation such that as the duration of the stop state is longer, heat transferring from the cylinder wall, the piston or the like to the air in the cylinder increases, causing the increase of the cylinder temperature. Here, as referring to the duration of the stop state, the possibility of the self-ignition can be determined appropriately.

Also, in one embodiment of the start control apparatus according to the first or second aspect, the fuel injection amount control device may control the fuel injection amount for a cylinder distinguished that the piston position at the stop of the internal combustion engine is in the intake stroke so that an air fuel ratio in the cylinder becomes lean relative to a theoretical air fuel ratio with respect to an air quantity in the cylinder. In this case, the air fuel ratio in the cylinder in which the piston stops in the intake stroke is more lean than stoichiometry, and therefore the pressure increase in the cylinder when starting the internal combustion engine can be restrained, and the rising thereof would not be rapid. Therefore, although the output torque may be small, the sound and vibration can be restrained. Furthermore, injecting excessive fuel is not required, and therefore the discharge of carbon dioxide (HC) can be minimized.

As explained above, according to the present invention, by increasing the fuel injection amount for the cylinder subject to starting of the piston from the intake stroke, the cylinder temperature can be reduced as using the vaporization latent heat of the fuel, and the self-ignition in the compression stroke can effectively be restrained. Also, by controlling the fuel injection amount in consideration of the stop position of the piston, the self-ignition restrain effect can effectively be exerted more, while the problems such as deteriorations of the fuel consumption and emission can be restrained.

BRIEF DESCRIPTION OF THE DRAWINGS

FIG. 7A is a front view and FIG. 7B is a side view;

BEST MODE FOR CARRYING OUT THE INVENTION

Figure 1:
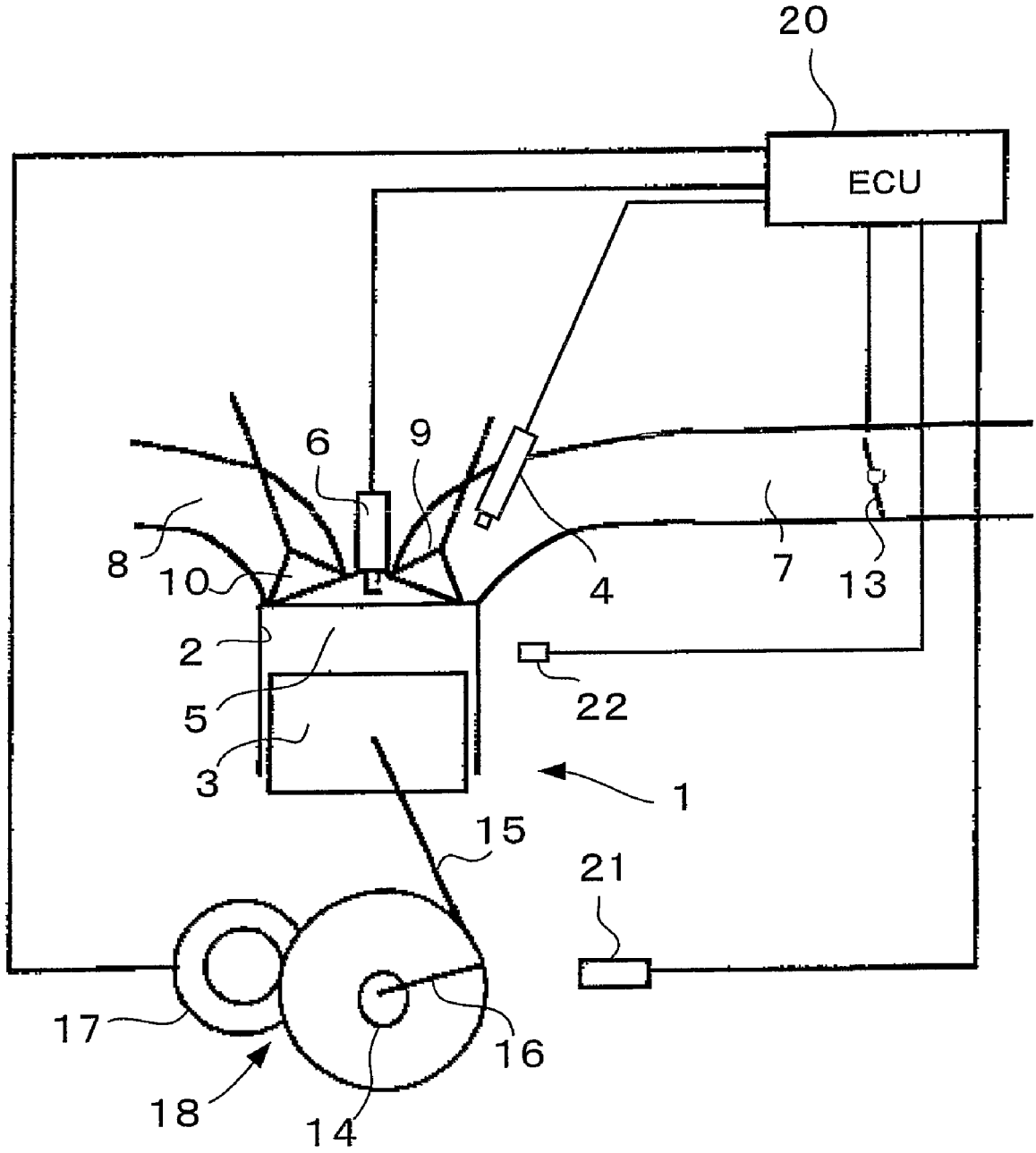
FIG. 1 is a view showing a schematic structure of an internal combustion engine for an automobile to which a start control apparatus according to one embodiment of the present invention is applied.

FIG. 1 is a view showing an internal combustion engine for an automobile to which a start control apparatus according to one embodiment of the present invention is applied. In FIG. 1, the internal combustion engine (hereinafter referred to as an engine) 1 is constructed as, for example, a 4-cycle engine and includes plural cylinders 2. Incidentally, FIG. 1 only shows a single cylinder 2 but structures of remaining cylinders 2 are the identical thereto.

The phase of a piston 3 in each cylinder 2 is displaced from each other in correspondence to the number and the layout of the cylinders 2. For example, in a straight four cylinder engine with four of cylinders 2 arranged in one direction, the phase of the piston 3 is displaced 180 degrees in the crank angel from each other. Therefore, one of four cylinders 2 is inevitably in the intake stroke. Furthermore, the engine 1 is constructed as a port injection type engine which injects fuel from a fuel-injection valve 4 to an intake port, introduces an air fuel mixture into the cylinder 2, and ignites the mixture by a sparkling plug 6. One example of the fuel to be injected from the fuel injection valve 4 is gasoline. Furthermore, the engine 1 is provided with an intake valve 9 and an exhaust valve 10 each of which opens and closes a space between a combustion chamber 5 and an intake passage 7 or an exhaust passage 8, a throttle valve 13 which adjusts an intake air amount from the intake passage 7, and a connecting rod 15 and a crank arm 16 which transmit reciprocating motion of the piston 3 to the crank shaft 14. This structure may be the same as that of the well-known engine.

The engine 1 is provided with a starter motor 17 for starting it. The starter motor 17 is a well-known electric motor which rotates the crank shaft 14 via a reduction gear mechanism 18. Incidentally, the reduction gear mechanism 18 has built-in one-way clutch which allows rotation transmission from the starter motor 17 to the crank shaft 14 while inhibits rotation transmission from the crank shaft 14 to the starter motor 17 on the way of its rotation transmission path. Accordingly, a gear as a part of the reduction gear mechanism 18 constantly meshes with the crank shaft 14. Therefore, the start device of the engine 1 is constructed as the so-called constant mesh type start device.

An operation state of the engine 1 is controlled by an engine control unit (hereinafter referred to as an ECU) 20. The ECU 20 is configured as a computer including a microprocessor and peripheral devices such as a RAM and a ROM that are necessary to operate the microprocessor and operates various necessary processes so as to control the operation state of the engine 1 according to a program stored in the ROM. For example, the ECU 20 detects pressure of the intake passage 7 and an air fuel ratio in the exhaust passage 8 from output signals of predetermined sensors and controls the fuel injection amount of the fuel injection valve 4 so as to attain a predetermined air fuel ratio. For sensors that the ECU 20 refers to, there are a crank angle sensor 21 which outputs a signal corresponding to the phase (crank angle) of the crank shaft 14 and a water temperature sensor 22 which outputs a signal corresponding to cooling water temperature of the engine 1. In addition, there are provided sensors, such as a sensor which detects opening degree of an accelerator pedal and a sensor which detects a brake stroke. Thereafter, the ECU 20 proceeds to step S5 and closes the throttle valve 13. Therefore, when the cylinder 2 with the introduced air shifts to the compression stroke beyond a bottom dead center (BDC) of the intake stroke, a compression resistance occurs and the rotation of the engine 1 is completely stopped duet to the resistance. At this time, the opening degree of the throttle valve 13 may be controlled so as to stop the piston 3 within a target crank angle range (for example BTDC80° CA to 180° CA) in the cylinder 2 in the compression stroke. When the piston 3 stops within such target range, the stop position of the piston 3 in the cylinder 2 to be in the compression stroke next, that is, the cylinder 2 in the intake stroke at stopping, becomes ATDC100° CA to 0° CA.

After the engine 1 stops, in step S6, the ECU 20 distinguishes the crank angle at stopping based on the output signal of the crank angle sensor 21 and stores the determined crank angle into a storage device (such as a RAM) in the ECU 20. That is, the ECU 20 determines which position the crank shaft 14 stops between 0° CA to 720° CA when the engine 1 stops, and stores the distinction result thereof. The crank angle is specified based on the condition that the piston 3 in any one of the cylinders 2 is located in a predetermined position (for example, the condition that the piston in the first cylinder is at the top dead center in the intake stroke), and therefore determining the crank angle during the stop is equivalent to determining the stop position of each piston 3. Accordingly, the ECU 20 serves as the stop position distinction device or pedal action, but they are omitted in the figure. Also, the engine 1 can operate the throttle valve 13 to control the operating degree thereof.

Figure 2:
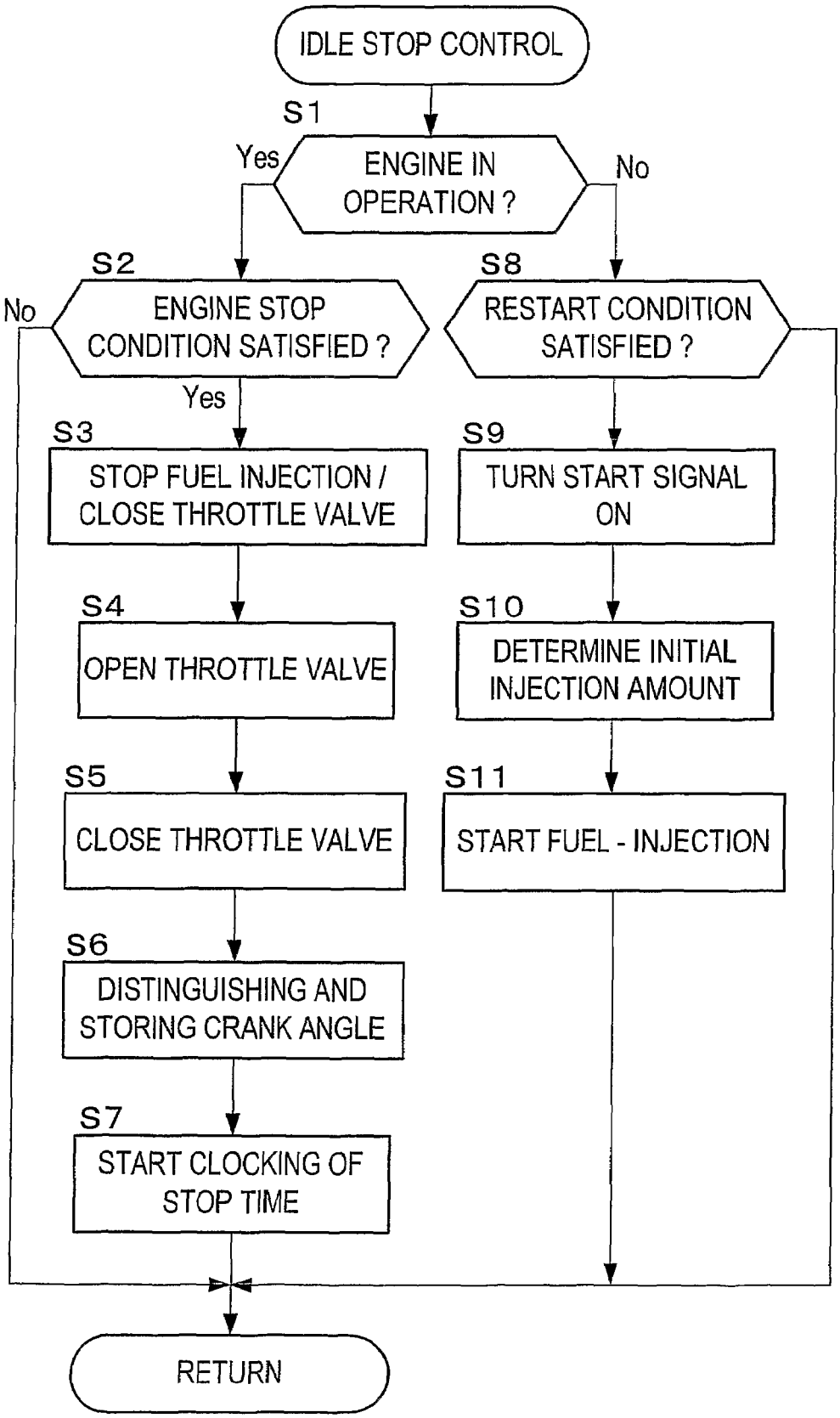
FIG. 2 is a flowchart showing an outline of an idle stop control routine that ECU performs.

The ECU 20 performs for the engine 1 the so-called idle stop control which stops the operation of the engine 1 when a predetermined stop condition is satisfied and restarts the engine 1 when a predetermined restart condition is satisfied. FIG. 2 is a flowchart showing an outline of an idle stop control routine that the ECU 20 performs. Incidentally, the routine in FIG. 2 is performed repeatedly at the predetermined cycle in parallel to a various processes that the ECU 20 performs.

In the routine of FIG. 2, the ECU 20 first determines whether or not the engine 1 is in operation at step S1, and if in operation, the ECU 20 proceeds to step S2. Instep S2, the ECU 20 determines whether or not the engine stop condition is satisfied. For example, if the brake pedal is operated and a vehicle speed is 0, the engine stop condition is satisfied. If the engine stop condition is not satisfied, the routine is ended. On the other hand, the engine stop conditioned is satisfied, the ECU 20 proceeds to step S3, stops an fuel injection from the fuel injection valve 4 and controls the throttle valve 13 to be completely closed. Accordingly, supply of the air fuel mixture to the cylinder 2 is prevented, and a rotating speed of the engine 1 begins to be reduced. When the rotating speed of the engine 1 reduces to a predetermined level just before the stop, the ECU 20 proceeds to step S4 and opens the throttle valve 13. Accordingly, the air is introduced in the cylinder 2 in the intake means according to the present invention by performing the process in step S6. After distinguishing the crank angle, the ECU 20 begins in step S7 to clock the duration of an idle stop state (stop time) and then ends the routine. The above-explanation is to the process for controlling the engine 1 to be in the idle stop state. However, the above-described procedure may properly be modified as long as the position of the piston 3 can be distinguished when stopping.

On the other hand, if it is determined in step S1 that the engine 1 is not in operation, the ECU 20 proceeds to step S8 to control the restart from the idle stop state and determines whether or not the predetermined restart condition is satisfied. In one example of a vehicle with an automatic transmission, the restart condition is satisfied when the brake pedal is released. In a vehicle with a manual transmission, the restart condition is satisfied such as by shifting a gear shift lever from a neutral position to a first gear, or stepping on the clutch pedal. If the restart condition is not satisfied, the routine is ended.

If the restart condition is satisfied, the ECU 20 proceeds to step S9 and turns a restart signal "ON" to restart the engine 1. Accordingly, start preparation necessary for starting the engine 1, such as inputting a seizure signal to a drive circuit of the starter motor 17, begins in various devices. In next step S10, the ECU 20 determines the fuel injection amount (initial injection amount) to the cylinder in which the piston 3 stops in the intake stroke (hereinafter referred to as a specific cylinder) according to predetermined procedures. Procedures of calculating the initial injection amount will be described later. In following step S11, the ECU 20 injects the determined initial injection amount from the fuel-injection valve 4 corresponding to the specific cylinder 2, thereby ending the routine.

Figure 3:
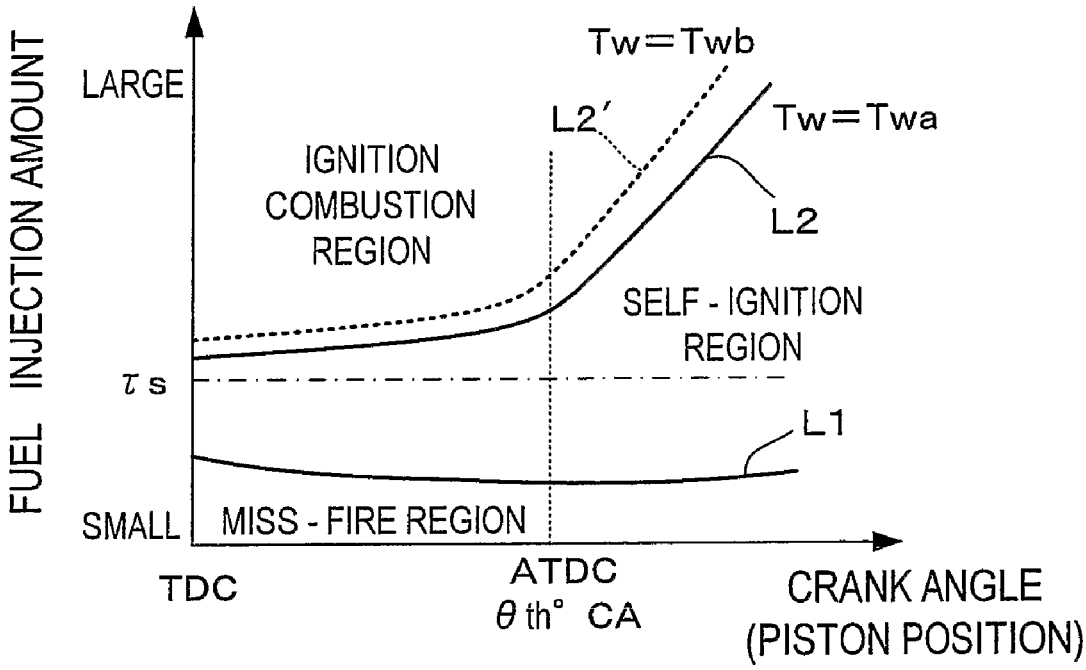
FIG. 3 is a graph showing a combustion state at restarting in a cylinder in which a piston stops in an intake stroke with making the state correspond to a piston position before restarting and a fuel injection amount.

Next, controlling of the initial injection amount will be explained. Firstly, a theory for determining the initial injection amount will be explained with reference to FIG. 3 and FIG. 4. FIG. 3 is a graph showing a combustion state at restarting in the specific cylinder 2 with making the state correspond to the piston position in the specific cylinder 2 before restarting and the fuel injection amount at restarting (initial combustion amount). Note that, in FIG. 3, the piston position is shown by the crank angle with the top dead center (TDC) which is a starting point of the intake stroke being considered as a base point. As distinguished in solid lines L1 and L2 in the figure, the combustion state may be divided into three regions, namely, a miss-fire region, a self-ignition region, and an ignition combustion region according to the fuel injection amount. Also, the fuel injection amount τs is the necessary fuel injection amount to realize a theoretical air fuel ratio. Hereinafter, the fuel injection amount τs is referred to as a stoichiometric requirement.

As is apparent from FIG. 3, if the fuel amount injected to the specific cylinder 2 when restarting is controlled to be around the stoichiometric requirement τs, air quantity in the. specific cylinder 2 is great and the cylinder temperature (air temperature in the cylinder) in the compression stroke significantly increases, thereby causing the self-ignition. In order to avoid such situation, the fuel injection amount needs to be set below a lower limit L1 of the self-ignition region or higher than an upper limit L2. However, if the fuel injection amount goes below the lower limit L1, it becomes the miss-fire region, and the engine 1 cannot be started normally. Accordingly, in order to avoid the self-ignition and to normally start the engine 1, the fuel injection amount needs to be set higher than the upper limit L2 of the self-ignition region. The reason why the self-ignition can be avoided by adjusting the fuel injection amount is that the cylinder temperature decreases due to the vaporization latent heat of the fuel. That is, the upper limit L2 of the self-ignition region represents the lower limit of necessary fuel amount to restrain the cylinder temperature lower than the ignition temperature due to the vaporization latent heat of the fuel. Hereinafter, the fuel injection amount represented by the upper limit L2 is referred to as an actually required amount.

However, the actually required amount L2 changes in correspondence to the piston position before restarting (namely, the position of the piston stopping in the intake stroke). Once the stop position of the piston 3 departs from the top dead center toward bottom dead center to some degree, the actually required amount L2 increases radically. It is because that, at the last half of the intake stroke, the remaining intake time is short and the flow rate and velocity of the air sucked into the cylinder 2 drop, so that a decrease effect on the cylinder temperature due to the vaporization latent heat cannot be sufficiently provided. Here, a piston position where the actually required amount L2 increases is set as a threshold value ATDCθth° CA in advance, and when the piston position in the specific cylinder 2 at restarting is on the TDC side from the threshold value ATDCθth° CA, the fuel injection amount is increased more than the actually required amount L2 to prevent the self-ignition. On the other hand, the piston position is beyond the threshold value ATDCθth° CA, the possibility of self-ignition is distinguished from the state of the engine 1, and if the possibility of self-ignition is high, the fuel-ignition to the specific cylinder 2 is inhibited to thereby prevent the self-ignition. Even if the piston position is beyond the threshold value ATDCθth° CA, the self-ignition can be avoided by increasing the fuel injection amount to the actually required amount L2 or more. However, the problems such as the increase of the fuel consumption and the deterioration of the emission due to the increase of the fuel injection amount become significant, and therefore in this case, the increase of the fuel amount taking the actually required amount L2 as a guideline is not performed. Also, even if the piston position is on the TDC side from the threshold value ATDCθth° CA, the problems such as the deterioration of the fuel consumption may arise when the fuel injection amount is excessively increased relative to the actually required amount L2. Therefore, the fuel injection amount at this time may accord with the actually required amount L2 or may be a degree where the increment is added to the actually required amount L2 in expectation of an error. One example is that the threshold value when the water temperature is 100° C. is about ATDC 100° CA.

Incidentally, the actually required amount L2 is affected by the cylinder temperature at restarting and can be changed due to the cooling water temperature as well as the piston position. For example, in FIG. 3, if the actually required amount corresponding to the water temperature Tw=Twa is represented by the solid line L2, when the water temperature is changed to Twb (>Twa), the actually required amount relatively increases as represented by the broken line L2' in comparison to the same piston position. Also, the above-described threshold value ATDCθth° CA shifts toward the TDC side. That is, as the water temperature at restarting is higher, the cylinder temperature relatively increases, and therefore more fuel-injection is necessary to avoid the self-ignition. Then, the water temperature Tw is considered when determining the fuel injection amount to the specific cylinder 2.

Figure 4:
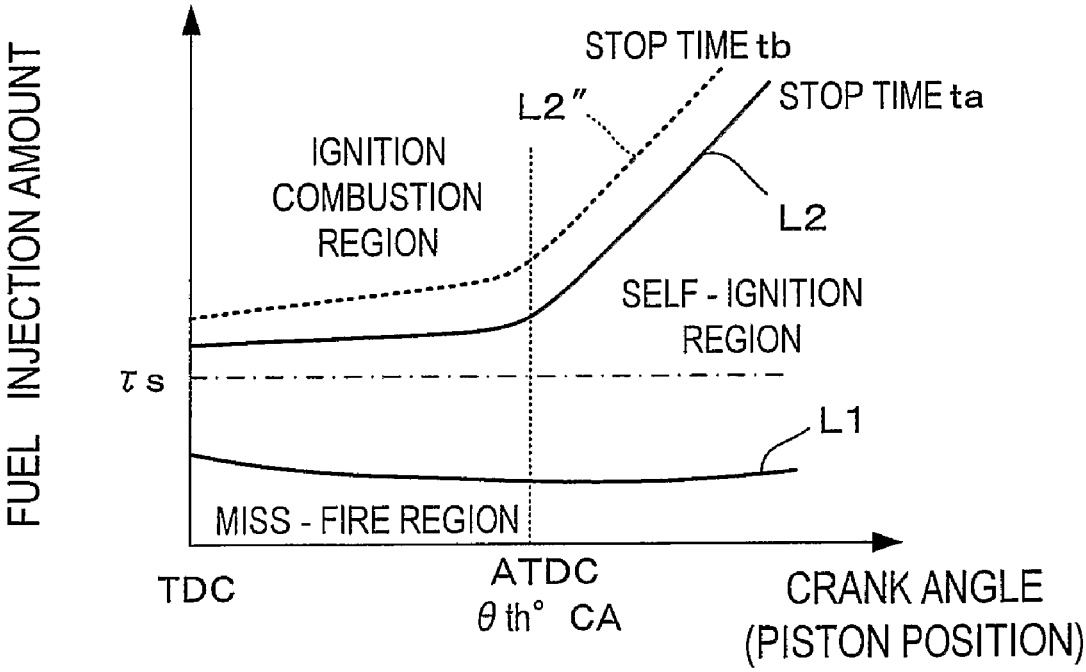
FIG. 4 is a graph showing a manner of changes of an actually required amount in relation to a stop time by idle stop control.

Furthermore, the actually required amount changes due to the duration (stop time) of the idle stop state as well as the water temperature. For example, in FIG. 4, provided that the actually required amount corresponding to the stop time ta is represented by the solid line L2, when the stop time is changed to tb (>ta), the actually required amount relatively increases in comparison with the same piston position as represented by the broken line L2". Also, the above-described threshold value ATDCθth° CA shifts to the TDC side. That is, as the stop time is longer, the amount of heat transfer from the wall surface of the cylinder 2 and the piston 3 to the cylinder air increases and the cylinder temperature increases, and therefore more fuel needs to be injected to avoid the self-ignition. Then, the stop time is considered when determining the fuel injection amount to the specific cylinder 2. Furthermore, the cylinder temperature is affected by such as atmospheric pressure, temperature and humidity in an environment in which the engine 1 is located, fuel temperature and wall temperature of the cylinder 2, and therefore, the fuel injection amount at restarting is determined in consideration of these physical values as necessary. For example, regarding the atmospheric pressure, as it is higher, the cylinder pressure in the compression stroke increases. Accordingly, when considering the atmospheric pressure, the actually required amount needs to relatively be increased as the atmospheric pressure is higher.

Figure 5:
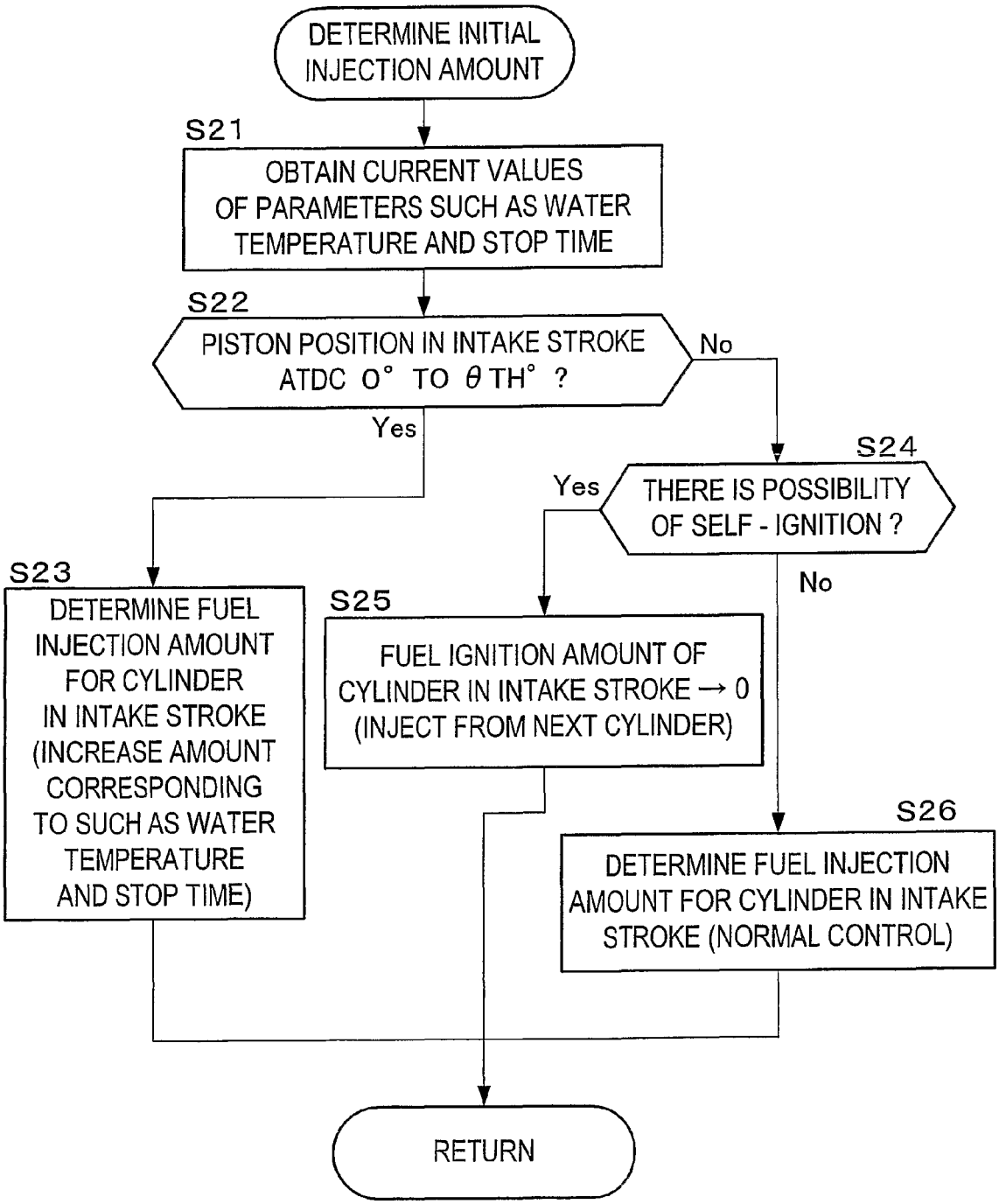
FIG. 5 is a flowchart showing an initial injection amount determination routine that ECU performs.

FIG. 5 shows the initial injection amount determination routine that the ECU 20 performs to determine the initial injection amount as described above. This routine is executed as a sub-routine of step S10 in FIG. 2, and the ECU 20 serves as the fuel injection amount control device or means by executing the routine. Incidentally, in the ROM of the ECU 20, there are stored data such as a map necessary to determine the above-described threshold value and the actually required amount in correspondence to the physical values such as the water temperature and stop time.

In the routine of FIG. 5, the ECU 20 firstly obtains current values of the water temperature, the stop time and the like as parameters necessary to determine the initial injection amount at step S21. The water temperature is specified from the output of the water temperature sensor. The stop time is specified from the clocking started at step S7 of FIG. 2. In next step S22, the ECU 20 distinguishes whether or not the position of the piston stopping in the intake stroke is within a range of ATDC0° CA to θth° CA based on the crank angle stored in step S6 of FIG. 2. If it is within the range, the ECU 20 proceeds to step S23, and the fuel injection amount to the specific cylinder (the cylinder in which the piston 3 stops in the intake stroke) 2 is determined in correspondence to the value of the parameters obtained in step S21. That is, by referring to the map using the values of the parameters obtained in step S21 as arguments, the fuel injection amount necessary to avoid the self-ignition can be obtained. The fuel injection amount at this time is determined to be equal to or greater than the actually required amount as shown in FIG. 3 and FIG. 4. Also, the fuel injection amount determined in step S23 is more than the fuel amount to be injected to other cylinders 2 at restarting. Because the specific cylinder 2 sucks the air during the idle stop state and the air quantity during the compression stroke is greater than those in other cylinders 2, unless the fuel injection amount is increased to the extent that the air quantity increases, the cylinder temperature cannot be lowered. Furthermore, as apparent in FIG. 3 and FIG. 4, the fuel injection amount determined in step S23 increases as the water temperature becomes higher or the stop time becomes longer. When determining the fuel injection amount further in consideration of another physical value affecting the cylinder temperature, the fuel injection amount should be increased as the physical value changes to increase the cylinder temperature.

On the other hand, if the piston position is determined to be outside the range in step S22, the ECU 20 proceeds to step S24 and determines whether or not there is a possibility of causing the self-ignition. This determination can be performed by referring to the physical values, similar to the above-described physical values affecting the actually required amount, namely, water temperature, stop time, atmospheric pressure in the environment in which the engine 1 is located, air temperature, humidity, fuel temperature, and wall temperature of the cylinder 2 that affects the cylinder temperature. For example, when the stop time is extremely short or the water temperature is extremely low (for example about the same level as the intake air temperature at the intake port), no self-ignition occurs even though the increase of the fuel injection amount is not performed, and therefore it can be determined that there is no possibility of self-ignition. Then, if it is determined that there is a possibility of self-ignition, the ECU 20 proceeds to step S25 and set the fuel injection amount to the specific cylinder 2 to be zero, namely, inhibiting the fuel-injection to the specific cylinder 2. On the other hand, if it is determined that there is no possibility of self-ignition, the ECU 20 proceeds to step S26 and sets the fuel injection amount for the specific cylinder 2 to the injection amount (stoichiometric requirement) at the normal control in which the increase of the fuel injection is not performed. The fuel injection amount in this case is smaller than the injection amount set in step S23. After determining the fuel injection amount in above-described step S23, S25 or S26, the ECU 20 ends the routine in FIG. 5. In step S11 of FIG. 2, the ECU 20 operates the fuel-injection valve 4 so as to inject the fuel injection amount determined in the above-procedure.

According to the above-described embodiment, when position of the piston stopping in the intake stroke is in the predetermined crank angle range (ATDC0° CA to θth° CA), the fuel injection amount to the cylinder 2 in the intake stroke is increased more than the actually required amount to avoid the self-ignition while if the position of the piston is beyond the crank angle range, the fuel injection amount to the cylinder 2 is inhibited to avoid the self-ignition unless it is determined that there is no possibility of the self-ignition. Accordingly, generation of the vibration or the like due to the self-ignition is avoided, thereby allowing the engine 1 to smoothly restart from the idle stop state.

Figure 6:
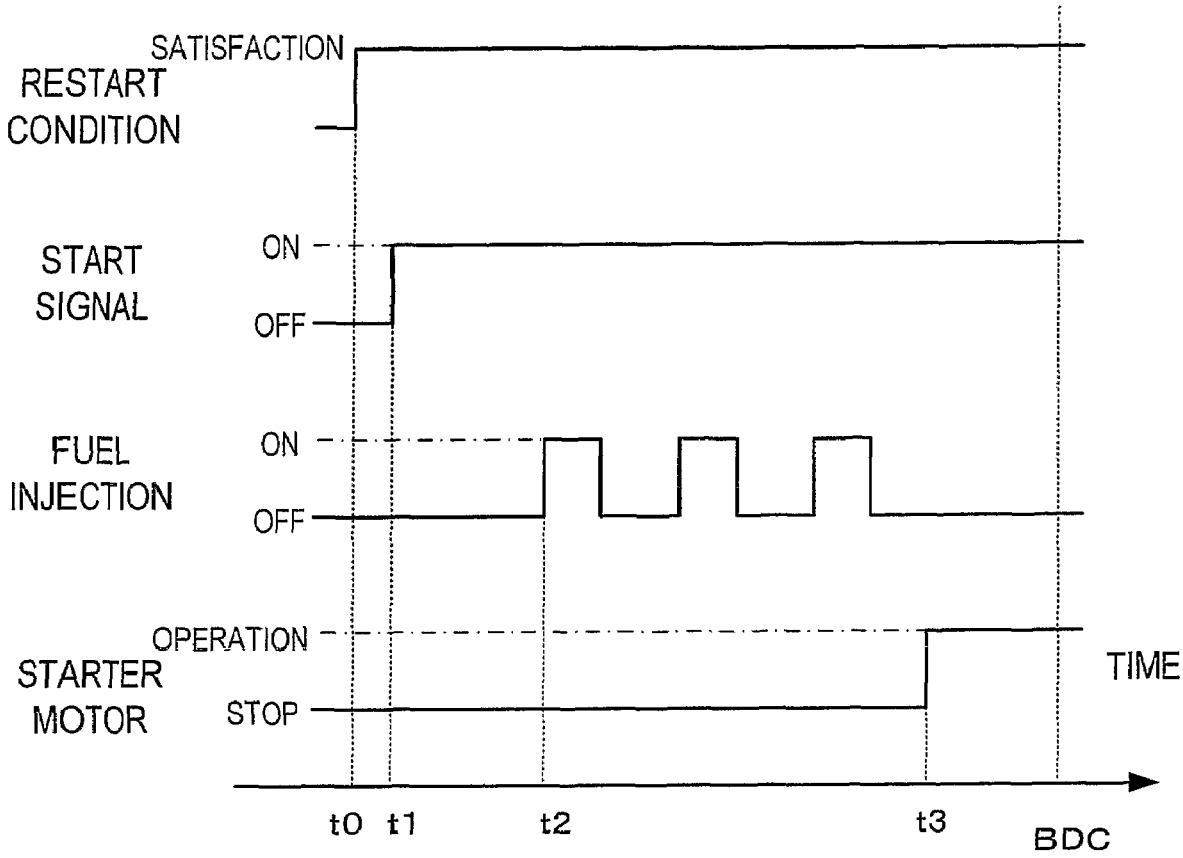
FIG. 6 is a time chart showing a lapse of time from establishment of a restart condition to an actual start of operation of a starter motor.

FIG. 6 is a time chart showing one preferable embodiment of fuel injection timing when the piston 3 in the specific cylinder 2 is stopping within the crank angle range. The restart condition is satisfied at the time t0, and even if the start signal is turned on at the time t1 thereafter, the starter motor 17 has a constant time lag until the time t3 where its operation actually stars. In order to sufficiently exert the temperature drop effect in the cylinder due to the fuel injection, sufficient time for mixing the injected fuel and the intake air needs to be secured, and therefore the fuel-injection is preferably performed at the time t2 between the time t1 to time t3. Furthermore, when injecting the large amount of fuel at one time, it is possible that the air fuel ratio in the cylinder is temporary significantly displaced to a rich side of the theoretical air fuel ratio, thereby decreasing vaporization rate of the fuel. Then, the fuel-injection is preferably divided and performed in plural actions as shown in FIG. 6.

In the above-embodiment, the threshold value ATDCθth° CA used in step S22 and the fuel injection amount decided in step S23 are determined in correspondence to the water temperature, the stop time, the atmospheric pressure and the lie. However, the self-ignition property of the fuel may change due to the composition of the fuel and the threshold value ATDCθth° CA and the actually required amount change as the self-ignition property changes. Accordingly, if the composition of the fuel available in the market is not constant, among all the fuel available in the market, the fuel that is most likely to cause the self-ignition can be considered as the reference to determine the above-threshold value and the actually required amount. For example, when the composition of the fuel is different depending on the destination of the vehicle with the engine 1 mounted thereon, self-ignitionablity of the fuel can be evaluated at every destination to determine the threshold value and the actually required amount.

The present invention is not limited to above-described embodiment, and may be implemented in various embodiments. For example, the engine in which the present invention can be used is not limited to the port injection type and may be a cylinder direct injection type. The present invention is not limited to the use when restarting from the idle stop state due to the idle stop control and can be used when starting by turning the ignition switch on. Accordingly, the present invention can be applied to not only the engine subjected to the idle stop control but to the engine in which the idle stop control is not performed. In the above-embodiment, the fuel injection amount is controlled based on the information as to whether or not the position of the piston stopping in the intake stroke is within the predetermined crank angle range, however, the present invention is not limited to the embodiment in which the fuel injection amount is controlled in correspondence to the piston position, and it should be considered to be within the scope of the present invention as long as the fuel injection amount to the cylinder in which the piston stops in the intake stroke is increased more than the fuel injection amount to other cylinders. For example, if no clear inflection point appears regarding the actually required amount as shown in FIG. 3 and FIG. 4, the piston position at the time of stopping is distinguished to specify the cylinder in which the piston stops in the intake stroke, and the fuel injection amount to the specified cylinder is increased more than other cylinders, thereby restraining the self-ignition in comparison with the case where no fuel increase is performed. In the above embodiment, the piston position is distinguished by the crank angle, however, the distinguishing the piston position is not limited hereto and various means may be used.

The present invention may be put into practice in combination with engine control other than the control of the fuel injection amount. For example, when the water temperature is low, air density is high and the air quantity introduced in the cylinder relatively increases, and therefore it is predicted that the torque obtained through combustion increases. In this case, by retarding the ignition timing, the maximum rotational speed of the engine obtained at ignition can be restrained, thereby restraining the effect to the engine vibration.

Also, in the present invention, the fuel injection amount for the cylinder in which the piston stops in the intake stroke may be controlled relative to the air quantity in this cylinder so as to make the air fuel ratio be a lean value in comparison with theoretical air fuel ratio. In this case, it may or may not be based on the premise that the fuel injection amount to the cylinder may be increased more than other cylinders. It is satisfactory as long as the air fuel ratio in the cylinder in which the piston stops in the intake stroke becomes lean with respect to the theoretical air fuel ratio as a result. This air fuel ratio A/F can be set for example as A/F=20 to 40. The fuel injection amount realizing the air fuel ratio is set, for example, in consideration of the fuel injection amount, acceleration, and starting speed accompanying the vibration of the engine 1.

Figure 7A:
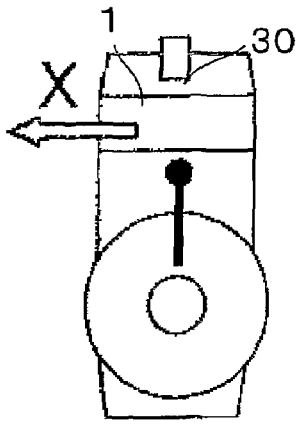
FIGS. 7A and 7B are explanatory diagrams showing coordinates when measuring acceleration accompanying a vibration of the engine, where
Figure 7B:
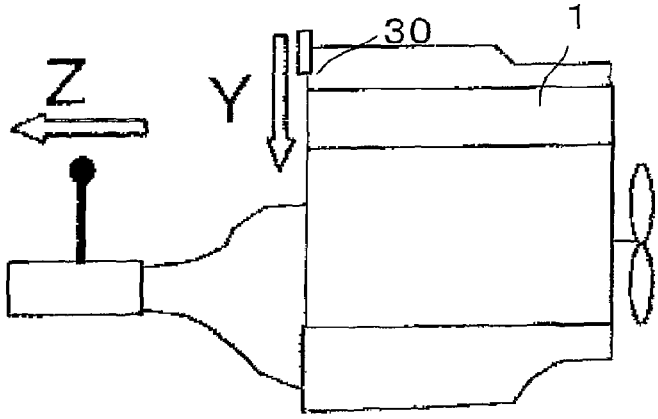
Figure 8:
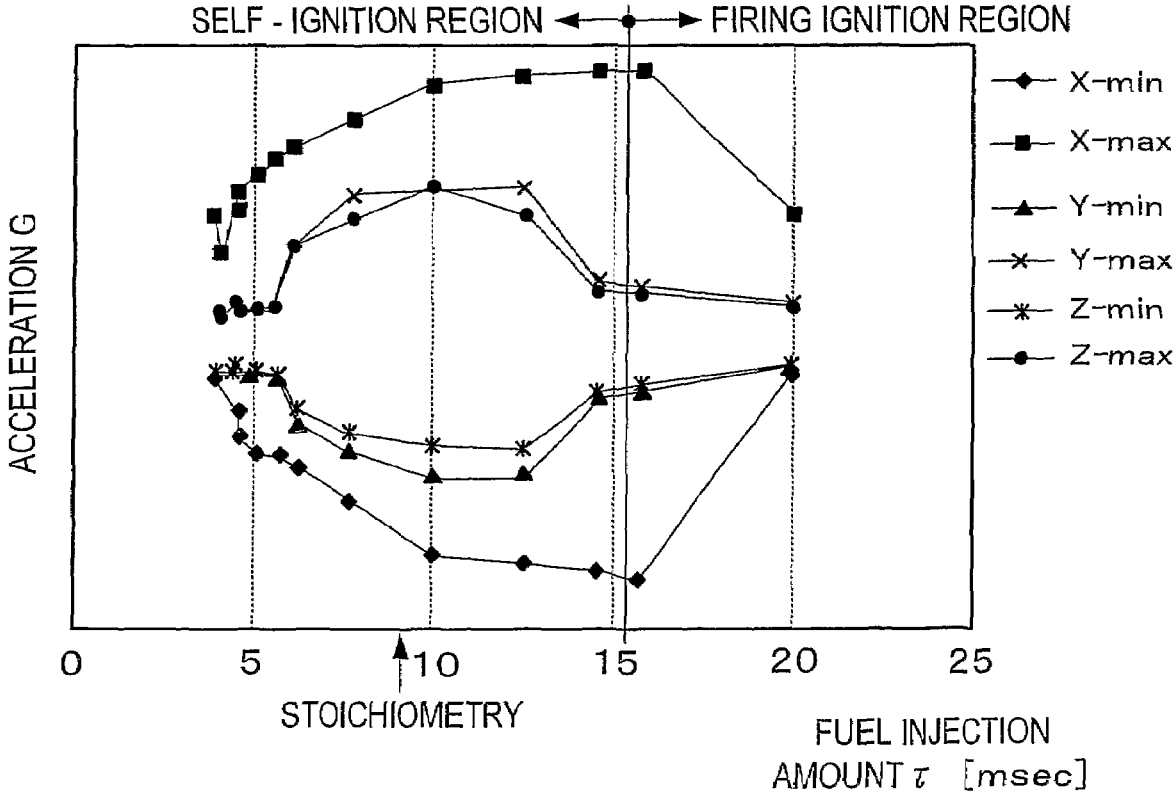
FIG. 8 is a graph showing relation between the acceleration during the vibration and a fuel injection amount.

Concretely, as shown in FIG. 8, in consideration of the fuel injection amount $\tau$ and of the acceleration G and the starting speed accompanying the vibration of the engine 1, the fuel injection amount capable of realizing lean air fuel ratio is adapted in advance as a base injection amount at the position where the minimum acceleration G is obtained within a target starting speed. The target starting speed may be set, for example, to be the lower limit which avoids the miss-fire. The acceleration G is measured by the acceleration sensor 30 in FIG. 7 and is shown by every composition X, Y, Z. FIG. 7 shows each of minimum values (X-min, Y-min, Z-min) and the maximum values (X-max, Y-max, Z-max) of the compositions X, Y, and Z, respectively, in association with the fuel injection amount. In an example of FIG. 8, the base fuel injection amount is adapted adjacent to the minimum acceleration G, namely, $\tau$=5 (msec). Then, to obtain the final fuel injection amount, the base injection amount may be increased or decreased in correspondence to at least one of various parameters such as piston stop position, cooling water temperature, intake air temperature, engine stop time, fuel property, and target engine rotational speed. Calculation for determining the final fuel injection amount can be performed by holding an injection amount correction map, in which the base injection amount is associated with at least one of the various parameters, in the ROM of the ECU 20 and referring thereto.

Figure 9:
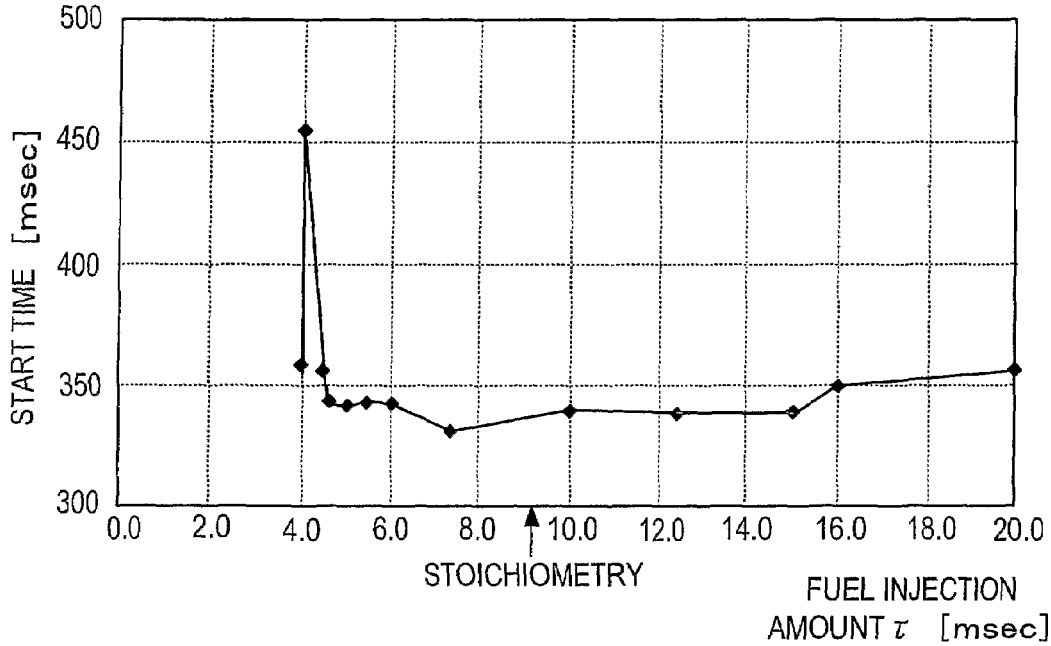
FIG. 9 is a graph showing relation between pressure in a cylinder and the fuel injection amount.
Figure 10:
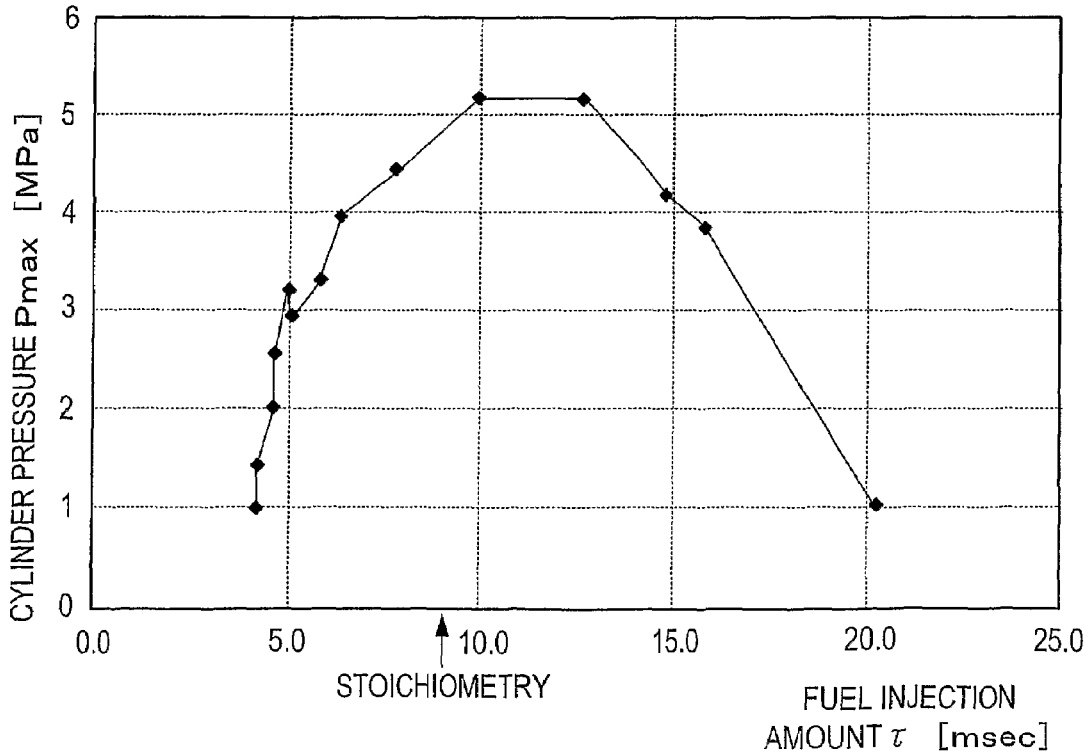
FIG. 10 is a graph showing relation between a start time and the fuel injection amount.

In the above-described configuration, as apparent in FIG. 8, the fuel injection amount is within the self-ignition region, thereby causing the self-ignition at starting. However, when the air fuel ratio in the cylinder in which the piston stops in the intake stroke is lean value with respect to stoichiometric value, the increase of the maximum value Pmax of the cylinder internal pressure can be restrained as shown in FIG. 9 and the rising state thereof is not radical. Therefore, although the output torque may be small, sound and vibration can be restrained (refer to FIG. 8). Also, as shown in FIG. 10, provided that the time required to reach 400 r.p.m. of the engine rotational speed from the beginning of starting is considered as the start time, the start time does not show a large difference between the cases that the air fuel ratios are stoichiometry and lean, and therefore the starting does not become difficult. Furthermore, the injection of excessive fuel is not required, and therefore discharge of hydrocarbon (HC) can be maintained minimum and unnecessary increase of the engine rotation can be avoided.

The invention claimed is:

1. A start control apparatus for an internal combustion engine which starts the engine with injecting fuel to each cylinder of the internal combustion engine in an intake stroke, the apparatus comprising:

a stop position distinction device which distinguishes a piston position at a time of a stop of the internal combustion engine; and a fuel injection amount control device which specifies a cylinder in which a piston stops in the intake stroke based on a distinction result of the stop position distinction device and which increases a fuel injection amount at starting for the specified cylinder more than a fuel injection amount for other cylinders.

2. The start control apparatus according to claim 1, wherein the fuel injection amount control device controls the fuel injection amount for a cylinder distinguished that the piston position at the stop of the internal combustion engine is in the intake stroke so that an air fuel ratio in the cylinder becomes lean relative to a theoretical air fuel ratio with respect to an air quantity in the cylinder.

3. A start control apparatus for an internal combustion engine which starts the engine with injecting fuel to each cylinder of the internal combustion engine in an intake stroke, the apparatus comprising:

a stop position distinction device which distinguishes a piston position at a time of a stop of the internal combustion engine; and a fuel injection amount control device which distinguishes whether or not a position of a piston stopping in the intake stroke is within a predetermined crank angle range with a start position of the intake stroke as a base point based on a distinction result of the stop position distinction device and which controls a fuel injection amount at starting for the cylinder in which the piston stops in the intake stroke based on a distinction result regarding the predetermined crank angle range.

4. The start control apparatus according to claim 3, wherein, in the case that the position of the piston stopping in the intake stroke is within the predetermined crank angle range, the fuel injection amount control device increases the fuel injection amount at starting for the cylinder in which the piston stops in the intake stroke more than a fuel injection amount for other cylinders.

5. The start control apparatus according to claim 3, wherein, in the case that the position of the piston stopping in the intake stroke is within the predetermined crank angle range, the fuel injection amount control device increases the fuel injection amount at starting for the cylinder in which the piston stops in the intake stroke more than in the case of exceeding the predetermined crank angle range.

6. The start control apparatus according to claim 3, wherein, in the case that the position of the piston stopping in the intake stroke exceeds the predetermined crank angle range, the fuel injection amount control device distinguishes whether or not self-ignition will generate in the cylinder in which the piston stops in the intake stroke with referring to at least one physical value in correlation to temperature in the cylinder at starting and inhibits the fuel injection at starting to the cylinder when distinguishing that the self-ignition will generate.

7. The start control apparatus according to claim 6, wherein the fuel injection amount control device distinguishes whether or not the self-ignition will generate with referring, when starting, to at least one of temperature of cooling water of the internal combustion engine, atmospheric pressure in an environment in which the internal combustion engine is located, air temperature of the environment, humidity of the environment, fuel temperature, and wall surface temperature of the cylinder in which the piston stops in the intake stroke as the physical value.

8. The start control apparatus according to claim 3, wherein the internal combustion engine is subjected to idle stop control which stops the internal combustion engine when a predetermined stop condition is satisfied and restarts the internal combustion engine when a predetermined restart condition is satisfied, and when restarting from a stop state due to the idle stop control, the fuel injection amount control device performs control of the fuel injection amount based on the distinction result of the piston position.

9. The start control apparatus according to claim 8, wherein the fuel injection amount control device distinguishes whether or not self-ignition will generate with referring to duration of a stop state due to the idle stop control as the physical value.

* * * * *